US007583921B2

(12) United States Patent
Kobayashi et al.

(10) Patent No.: US 7,583,921 B2
(45) Date of Patent: Sep. 1, 2009

(54) IMAGE FORMING APPARATUS AND TRANSFER UNIT

(75) Inventors: Takuya Kobayashi, Saitama (JP); Masaki Suto, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/599,401

(22) Filed: Nov. 15, 2006

(65) Prior Publication Data

US 2007/0253754 A1 Nov. 1, 2007

(30) Foreign Application Priority Data

May 1, 2006 (JP) ..... 2006-127457

(51) Int. Cl.
*G03G 15/08* (2006.01)
*G03G 15/01* (2006.01)
*G03G 15/20* (2006.01)

(52) U.S. Cl. ..... 399/303; 399/121; 399/313

(58) Field of Classification Search ..... 399/299, 399/302, 303, 306, 308, 111.121, 313
See application file for complete search history.

(56) References Cited

U.S. PATENT DOCUMENTS 6,834,174 B2 * 12/2004 Imaizumi et al. ..... 399/162
6,839,531 B2 * 1/2005 Saitoh et al. ..... 399/167
6,876,821 B2 * 4/2005 Ishii et al. ..... 399/49
7,002,608 B2 * 2/2006 Sato ..... 347/115
2005/0095029 A1 * 5/2005 Kitamura ..... 399/102

FOREIGN PATENT DOCUMENTS

JP 05-333707 A 12/1993
JP 09281761 A * 10/1997
JP 11-015227 A 1/1999
JP 2001154446 A * 6/2001
JP 2002-193471 A 7/2002

* cited by examiner

*Primary Examiner*—David M Gray
*Assistant Examiner*—Joseph S Wong
(74) *Attorney, Agent, or Firm*—Sughrue Mion, PLLC

(57) ABSTRACT

An image forming apparatus for forming an image on a recording medium, includes: a belt-like member that is capable of cyclic rotation; a plurality of support members, along which the belt-like member is stretched; a first member that is located along an inner face of the belt-like member; and a regulator that is located opposite the inner face of the belt-like member, wherein the regulator maintains a cyclic rotating state for the belt-like member while ensuring the first member is separated by a gap from the belt-like member.

15 Claims, 8 Drawing Sheets

IMAGE FORMING APPARATUS AND TRANSFER UNIT

BACKGROUND

1. Technical Field

The present invention relates to electrophotographic image forming apparatuses that perform either copier, printer or facsimile machine functions, or to multifunctional apparatuses that perform all of these functions, and to transfer units that are employed for these image forming apparatuses.

2. Related Art

In an electrophotographic image forming apparatus such as a copier or a printer, for example, a developing device (a developing unit) employs a developer to form an electrostatic latent image on a photosensitive drum, and then, the toner image produced on the photosensitive drum is transferred and fixed to a recording medium, conveyed by a sheet feeding unit, to obtain a printed image. Some image forming apparatuses of this type include a belt conveying device, such as an endless intermediate transfer belt, a photosensitive belt or a sheet conveying belt. More specifically, intermediate transfer belts are provided for certain color image forming apparatuses, of a tandem type, that include image forming units for the individual colors yellow, magenta, cyan and black.

Generally, for a belt drive unit for which, to support an endless belt, there are provided a predetermined number of rollers, certain of which are employed to drive the endless belt, the endless belt, while being driven, is shifted width wise (perpendicular to the direction in which the belt is being driven), i.e., a so-called belt walk phenomenon (belt skewing) occurs. This belt walk phenomenon causes the positions of individual color images to be shifted when the tandem color image forming apparatus transfers and superimposes these images on the intermediate transfer belt. That is, belt walk causes misregistration and the uneven application of image colors. Therefore, in order to produce a high quality image, belt walk must be prevented.

SUMMARY

According to an aspect of the invention, there is provided an image forming apparatus for forming an image on a recording medium, which comprises:

a belt-like member that is capable of cyclic rotation;

a plurality of support members, along which the belt-like member is stretched;

a first member that is located along an inner face of the belt-like member; and a regulator that is located opposite the inner face of the belt-like member, wherein the regulator maintains a cyclic rotating state for the belt-like member while ensuring the first member is separated by a gap from the belt-like member.

BRIEF DESCRIPTION OF THE DRAWINGS

Embodiment(s) of the present invention will be described in detail based on the following figures, wherein.

DETAILED DESCRIPTION

The preferred embodiments of the present invention will now be described in detail while referring to the accompanying drawings.

Figure 1:
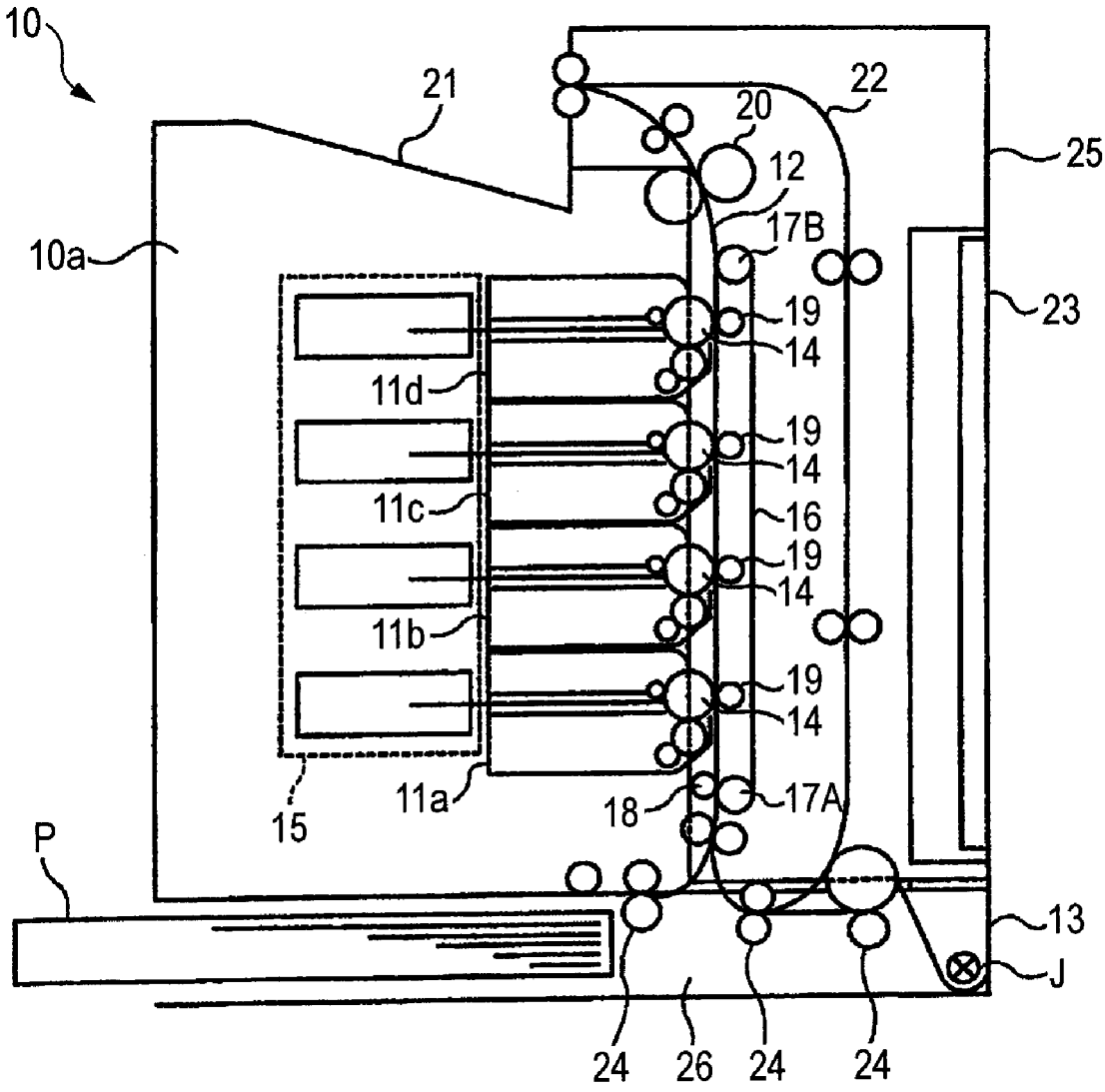
FIG. 1 is a schematic diagram showing the configuration of an image forming apparatus according to an aspect of the present invention.

FIG. 1 is a schematic diagram showing the configuration of an image forming apparatus according to an aspect of the invention.

An image forming apparatus 10 in FIG. 1 is a so-called tandem type, wherein processing cartridges (image forming units or drum cartridges) for four colors 11*a*, 11*b*, 11*c* and 11*d* are sequentially arranged, vertically, within a main body 10*a*. A conveying path 12, along which a sheet (a recording medium) P is to be conveyed substantially perpendicularly upward, from below, is appropriately arranged relative to the processing cartridges 11*a* to 11*d*. A sheet cassette 13 is located below (upstream of) the lowermost (furthest upstream) processing cartridge 11*a*, for storing sheets P, each of which is to be conveyed along the conveying path 12, to which toner images are sequentially to be transferred. In accordance with the size of the sheets P stacked in the sheet cassette 13, part of the sheet cassette 13 is projected outward, to the back of the main body 10*a* (the rear side or the rear wall side). When the sheets P are small, the sheet cassette 13 does not project outward from the main body 10*a*.

The processing cartridges 11*a* to 11*d* form yellow (Y), magenta (M), cyan (C) and black (K) toner images, beginning upstream, along the conveying path 12. The individual processing cartridges 11*a* to 11*d* are cartridges produced by packaging photosensitive drums (image bearing members) 14 and various types of electrophotographic devices that are arranged around the photosensitive drums 14. These electrophotographic devices are: charge rollers, for the prior electrification of the photosensitive drums 14; developing devices, for employing corresponding toners to develop electrostatic latent images, formed through the exposure of the photosensitive drums 14 that have been electrified by the charge rollers; and cleaning devices, for removing waste toner from the photosensitive drums 14.

An exposure device (ROS) 15, used in common by the processing cartridges 11*a* to 11*d*, is located on the opposite side, along the conveying path 12 for the processing cartridges 11*a* to 11*d*. The exposure device 15 controls four semiconductor lasers (not shown), based on image data consonant with the individual colors. Beams emitted by the four semiconductor lasers, which are to be used for scanning, are deflected by polygon mirrors (not shown), and these beams are guided through fθ lenses, and by a plurality of reflecting mirrors (none of them shown), to exposure points on the photosensitive drums 14, whereon they form optical images.

A conveying belt (a belt-like member or a transfer belt) 16, which cyclically rotates along the conveying path 12, is arranged at a location corresponding to the photosensitive drums 14 of the processing cartridges 11*a* to 11*d*. The conveying belt 16 is composed of a material that can electrostatically attract a sheet P, and is extended between a paired driven roller (a support member) 17A and a drive roller (a support member) 17B. Further, an attraction roller 18, for electrostatically attracting a sheet P to the conveying belt 16, is provided along the conveying path 12.

Transfer rollers 19 are arranged, along the reverse face of the conveying belt 16, at locations corresponding to the photosensitive drums 14 of the processing cartridges 11*a* to 11*d*. The transfer rollers 19 are used to facilitate the transfer of toner images from the photosensitive drums 14 to a sheet P, while the sheet P is held on the transfer belt 16 so as to closely contact the photosensitive drums 14.

A fixing device 20 is arranged along the conveying path 12 above (downstream of) the topmost (furthest downstream) processing cartridge 11*d*. In the upper portion of the main body 10*a*, a discharge unit 21 is integrally formed with the main body 10*a* for storing sheets P to which toner images have been fixed by the fixing device 20 and which are discharged thereafter. Further, in the main body 10*a*, an inversion conveying path 22 is arranged to invert the sides of the sheet P to which an image has been fixed by the fixing device 20, and to again feed the sheet P to the conveying path 12.

Figure 2:
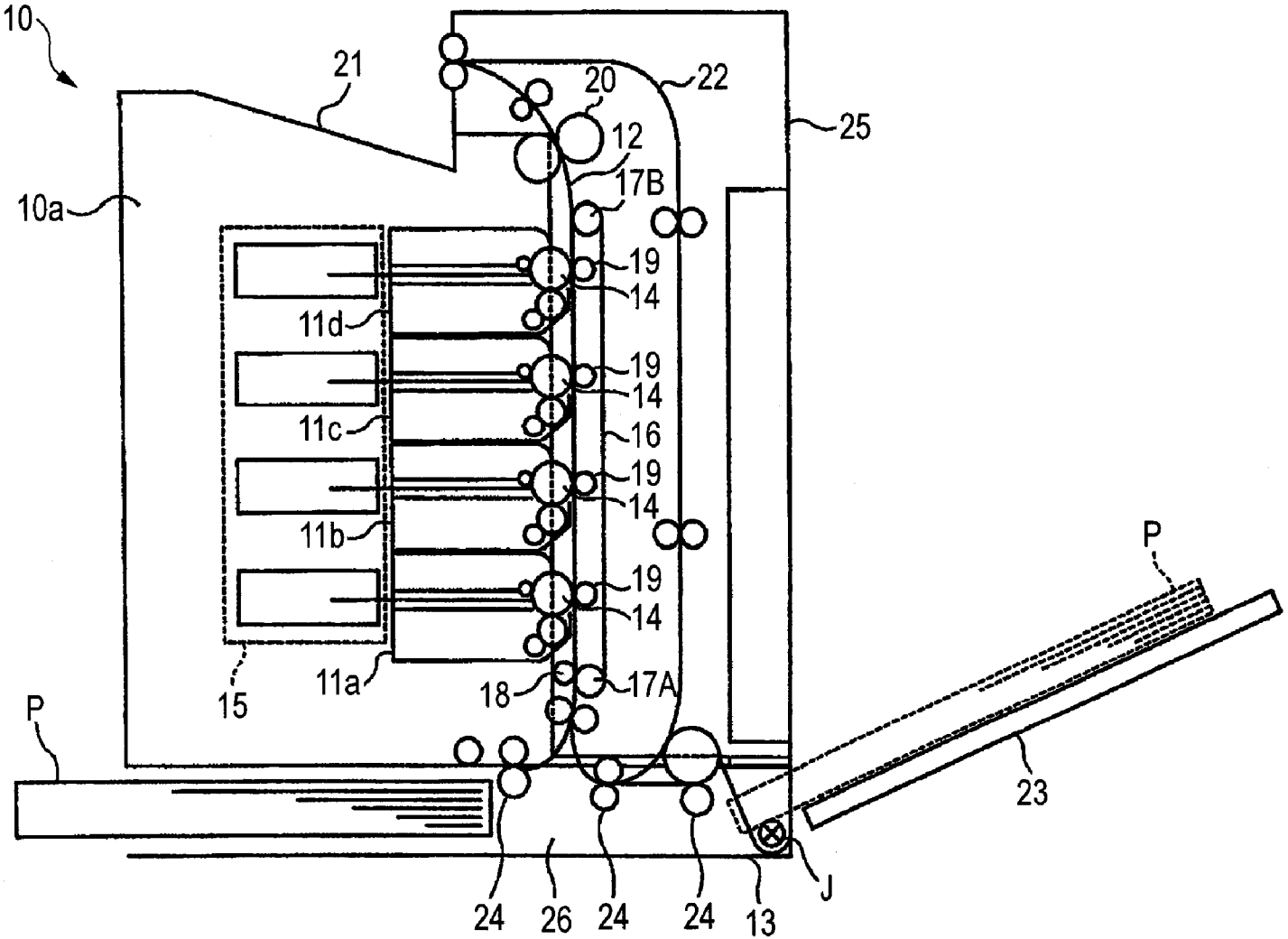
FIG. 2 is a diagram for explaining the operation of a manual feeding tray.

FIG. 2 is a diagram for explaining a manual feeding tray 23.

As shown in FIG. 2, the manual feeding tray 23 is provided for the main body 10*a* of the image forming apparatus 10, and can pivot at a fulcrum J provided at the lower end. That is, the manual feeding tray 23 can be opened or closed to the near side (to the front, or to the outer side). When the manual feeding tray 23 is pivoted to open, desired sheets P can be inserted into an insertion slot (not shown). As described above, the image forming apparatus 10 is designed so that sheets P, other than those sheets P stacked in the sheet cassette 13, can be supplied via the manual feeding tray 23.

When sheets P to which toner images are to be transferred are set up and a user issues an instruction to a controller (not shown), either a sheet P in the sheet cassette 13 or a sheet P in the manual feeding tray 23 is fed at a predetermined timing. The sheet P is then guided to the conveying path 12 via a plurality of conveying rollers 24, and is conveyed along the conveying belt 16 to the transfer positions for the individual processing cartridges 11*a* to 11*d*.

Figure 3:
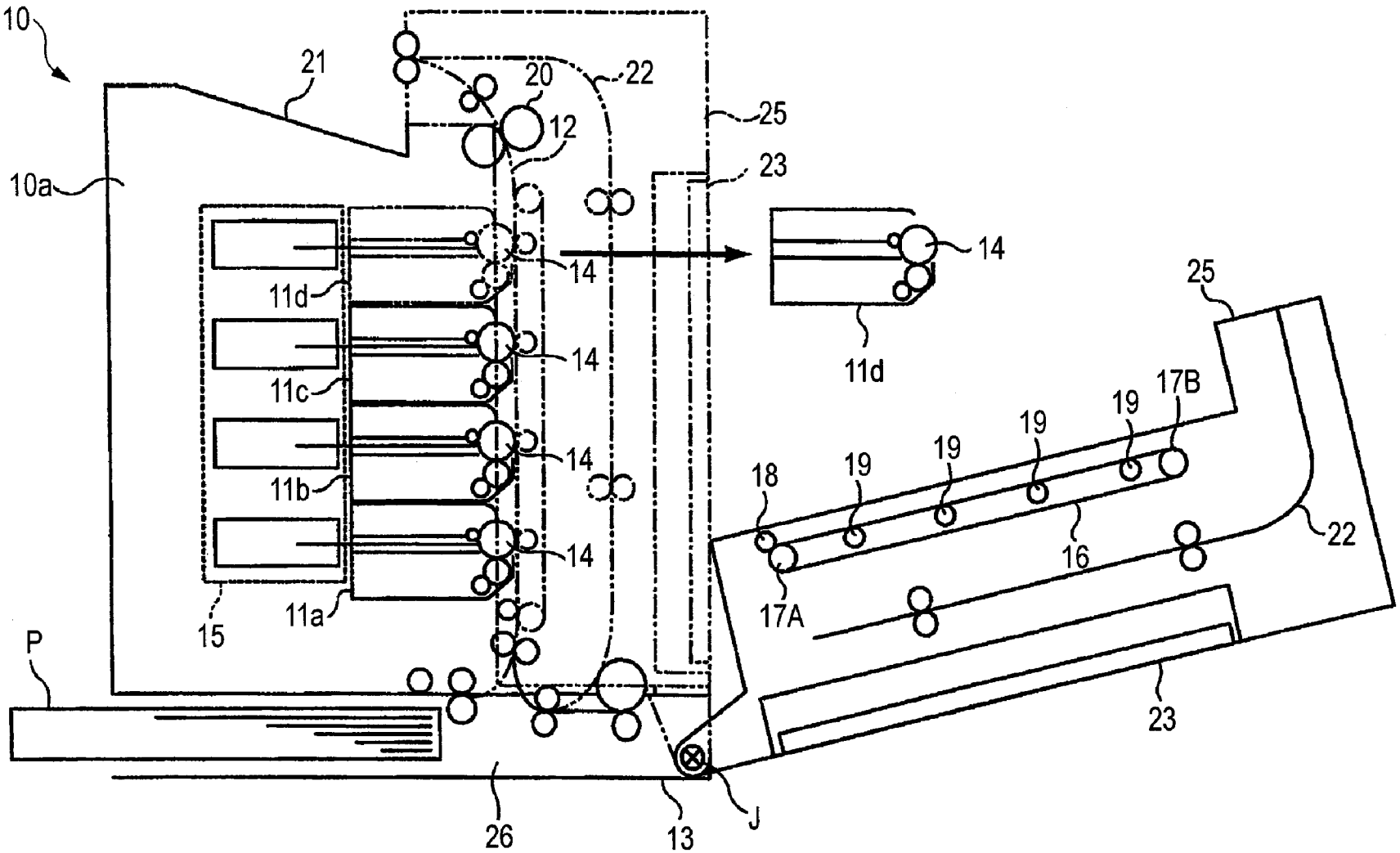
FIG. 3 is a diagram for explaining the employment of a front cover.

FIG. 3 is a diagram for explaining a front cover 25.

As shown in FIG. 3, a front cover 25 provided for the main body 10*a* of the image forming apparatus 10 pivots at a fulcrum J located at its lower end. In the closed state, the front cover 25, along with the main body 10*a*, serves as an outer cover. That is, the front cover 25 serves as the front side wall of the image forming apparatus 10 above the sheet cassette 13.

The conveying belt 16, the driven roller 17A, the drive roller 17B, the attraction roller 18, the transfer rollers 19 and the inversion conveying path 22 are mounted in the front cover 25. Therefore, when the front cover 25 is opened, accordingly, these parts are separated from the main body 10*a*. Thus, when the front cover 25 is opened, the processing cartridges 11*a* to 11*d* are exposed and a user can easily access the conveying path 12.

The individual processing cartridges 11*a* to 11*d* are mounted so that they are almost horizontally detachable from the main body 10*a*. Therefore, when the front cover 25 of the main body 10*a* has been opened, the processing cartridges 11*a* to 11*d* can be detached. It should be noted that a set detection sensor (not shown) detects the setting states of the processing cartridges 11*a* to 11*d*, and outputs the detection results to the controller (not shown).

As described above, by opening the front cover 25, the processing cartridges 11*a* to 11*d* can be exposed and exchanged. Further, since the photosensitive drums 14 are also exposed, paper jamming can be coped with (jams can be cleared). In this manner, maintenance of the image forming apparatus 10 is improved.

Figure 4:
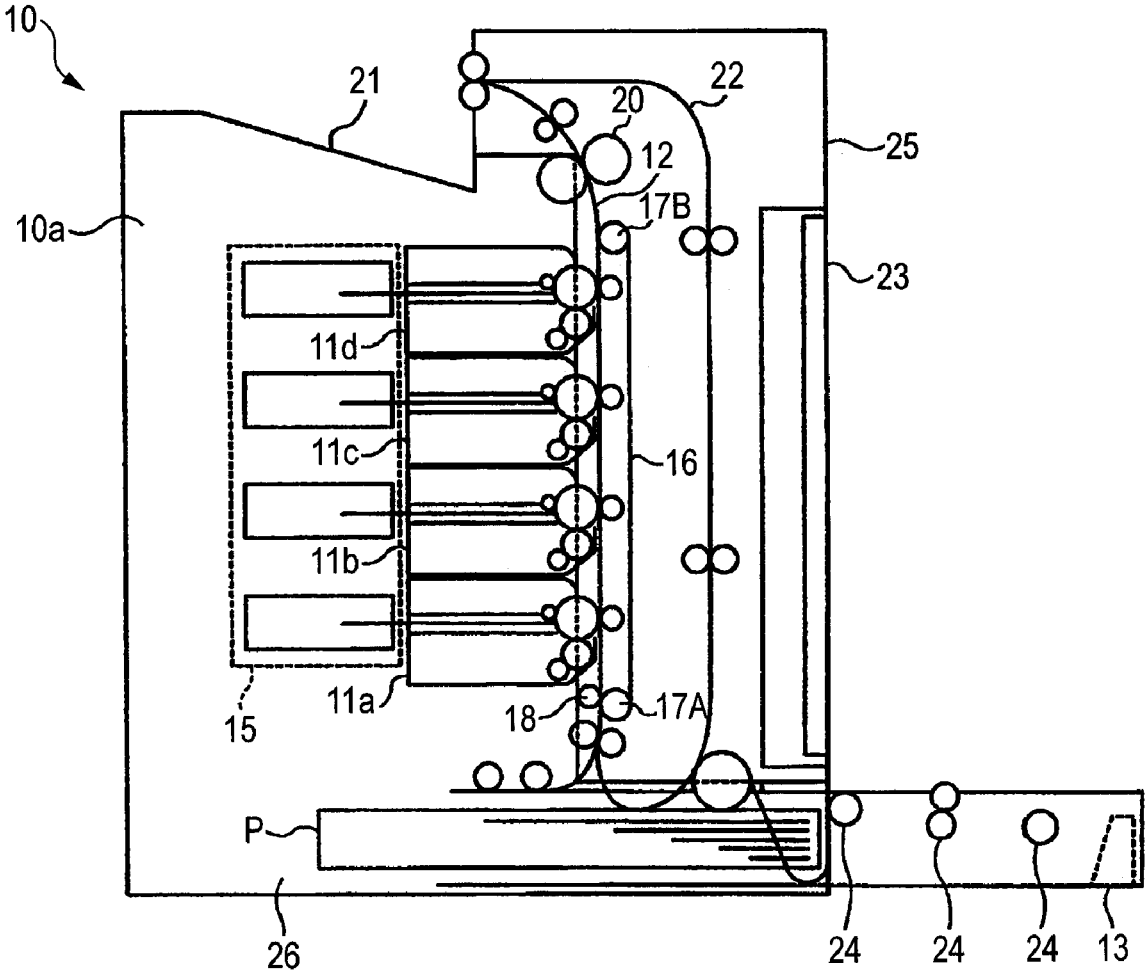
FIG. 4 is a diagram for explaining the state of a sheet cassette when pulled forward.

FIG. 4 is a diagram for explaining the state wherein the sheet cassette 13 is pulled to the front.

The sheet cassette 13 is stored in a cassette accommodating portion 26 in the main body 10*a*, and is to be extracted from the front of the main body 10*a*. More specifically, while the manual feeding tray 23 and the front cover 25 are closed, the sheet cassette 13 can be extracted from or inserted into the cassette accommodating portion 26.

An insertion slot is formed in the sheet cassette 13 to set up sheets P for the manual feeding tray 23. Furthermore, some of the conveying rollers 24, for conveying the sheets P from the manual feeding tray 23, are provided for the sheet cassette 13. As described above, a feeding path, along which a sheet P set up at the insertion slot is guided to the conveying path 12, is formed in the sheet cassette 13.

FIRST EXEMPLARY EMBODIMENT

Figure 5:
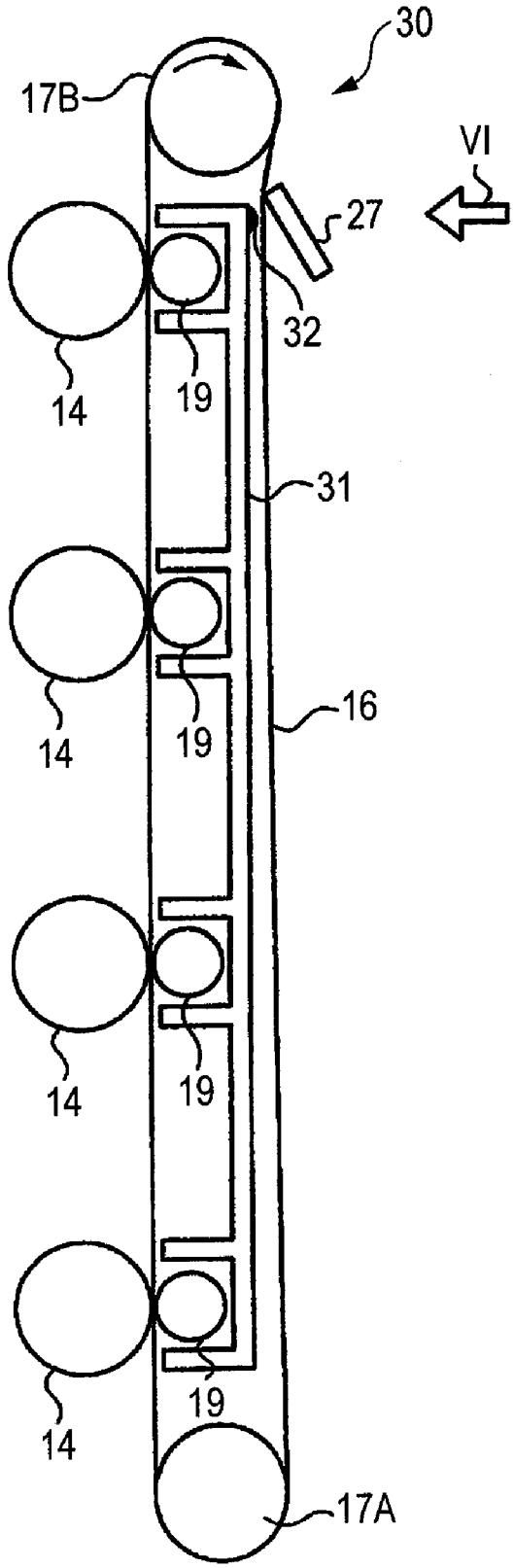
FIG. 5 is a diagram for explaining a transfer unit according to a first exemplary embodiment of the present invention.

FIG. 5 is a diagram for explaining a transfer unit 30 according to a first exemplary embodiment of the present invention. The transfer unit 30 is a unit obtained by integrally forming the conveying belt 16, the driven roller 17A, which is positioned low, so as to support the conveying belt 16, the drive roller 17B, which is positioned high, so as to support the conveying belt 16, and which is a driver for driving the conveying belt 16, the attraction roller 18 (see FIGS. 1 to 4) and the transfer rollers 19. The transfer unit 30 is to be exchanged during checkup servicing or maintenance, and should be handled separately from the image forming apparatus 10. In FIG. 5, the attraction roller 18 is not shown.

As shown in FIG. 5, the transfer unit 30 includes a box (member) 31 of the transfer unit 30 that is located inside the conveying belt 16. The box member 31 is positioned between the driven roller 17A and the drive roller 17B that support the conveying belt 16. The box member 31 is made of metal and is sufficiently rigid to hold the four transfer rollers 19 and to permit them to rotate.

The transfer unit 30 also includes a regulating member (a regulator) 32. That is, a cleaner 27 for cleaning the conveying belt 16 is arranged downstream of the drive roller 17B, and the regulating member (the regulator) 32 is located on the box member 31, downstream, immediately behind the cleaner 27.

The regulating member 32 is located on the face of the box member 31, opposite the transfer roller 19 and facing the inner wall of the conveying belt 16, and maintains the gap between the conveying belt 16 and the box member 31. That is, the regulating member 32 is arranged so it faces the inner wall of the conveying belt 16 and maintains the conveying belt 16 so that it does not contact the box member 31.

A device composed of a comparatively soft material, such as a sponge or a brush, is used for the regulating member 32, so that when the regulating member 32 contacts the inner wall of the conveying belt 16, it will neither damage the conveying belt 16 nor reduce its service life. That is, the regulating member 32 is made of a material that is more easily abraded and has a smaller friction coefficient than has the material used for the conveying belt 16.

The cleaner 27 impels the conveying belt 16 toward the box member 31 to ensure the performance of an adequate cleaning function. Thus, the clearance between the conveying belt 16 and the box member 31 is minimal near the cleaner 27, so that the conveying belt 16 may contact the box member 31. Further, the probability such a contact will occur is high because the side downstream of the drive roller 17B is the slack side, not the taut side. Therefore, in this exemplary embodiment, the regulating member 32 is provided on the box member 31 where the clearance relative to the conveying belt 16 is reduced. As a result, when the conveying belt 16 fluctuates during cyclic rotation, the regulating member 32 can restrain the conveying belt 16. And thus, since the regulating member 32 is so arranged, excessive friction exerted against the box member 31 can be prevented and the appearance on the conveying belt 16 of belt stripes (areas of surface roughness), which would adversely affect the appearance of an image, can be avoided.

In this exemplary embodiment, the regulating member 32 is located at a corner of the box member 31. However, the regulating member 32 may be arranged at another location whereat the clearance, relative to the conveying belt 16 is minimal, or at a location whereat the conveying belt 16 is the slackest.

Figure 6:
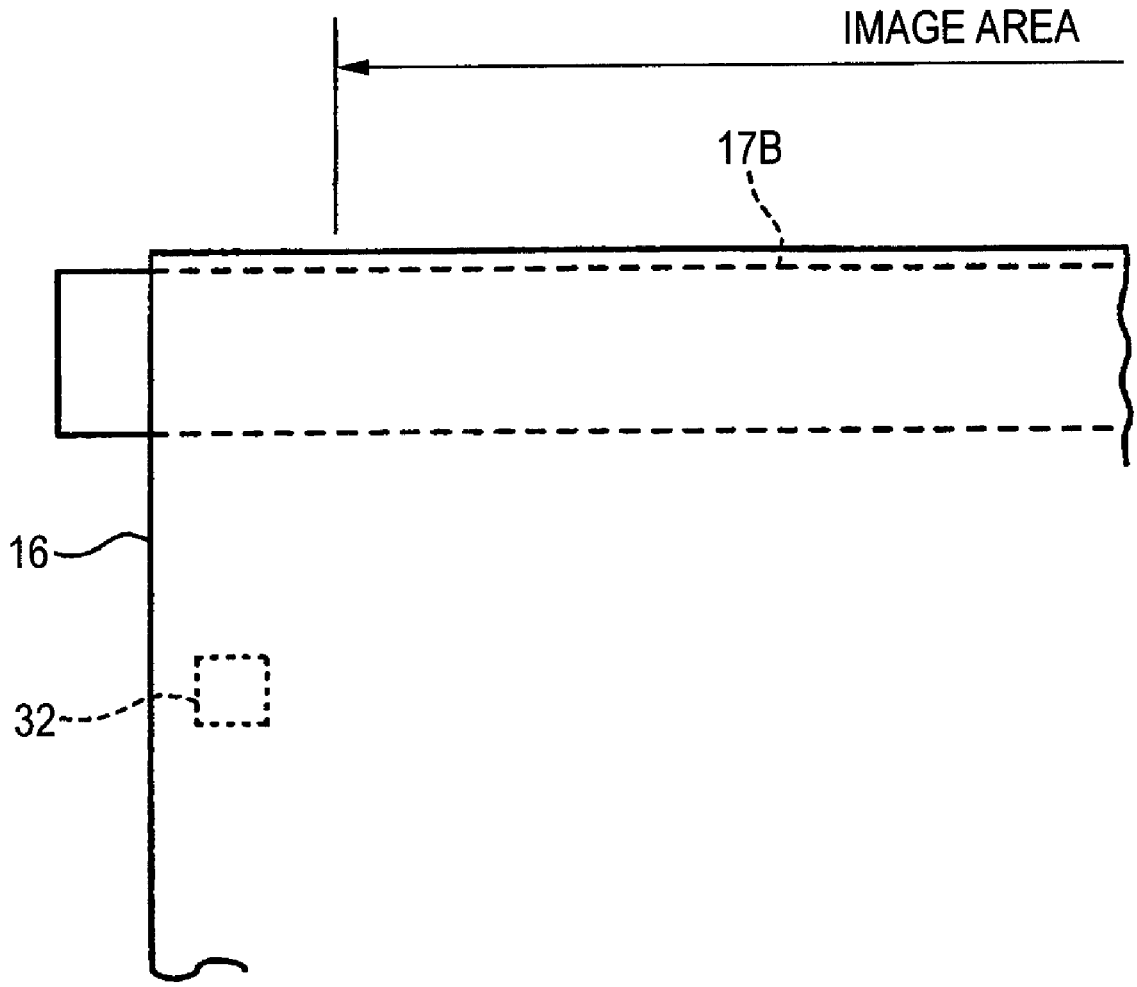
FIG. 6 is a diagram showing the transfer unit viewed from the direction indicated by an arrow VI in FIG. 5.

FIG. 6 is a diagram showing the transfer unit 30 as viewed from the direction indicated by an arrow VI in FIG. 5. For convenience sake, and to simplify the explanation, the cleaner 27 is not shown in FIG. 6.

As shown in FIG. 6, the regulating member 32 is attached to the box member 31 so that it is positioned outside the image area on the conveying belt 16. In other words, the regulating member 32 is attached to the box member 31 outside the portion corresponding to the image area on the conveying belt 16. Therefore, should a belt stripe appear on the conveying belt 16 due to contact with the regulating member 32, the location of the belt stripe will be outside the image area on the conveying belt 16. Thus, the occurrence of stripes in the image area on the conveying belt 16 can be prevented, and the affect such stripes may have on an image can be avoided.

SECOND EXEMPLARY EMBODIMENT

Figure 7:
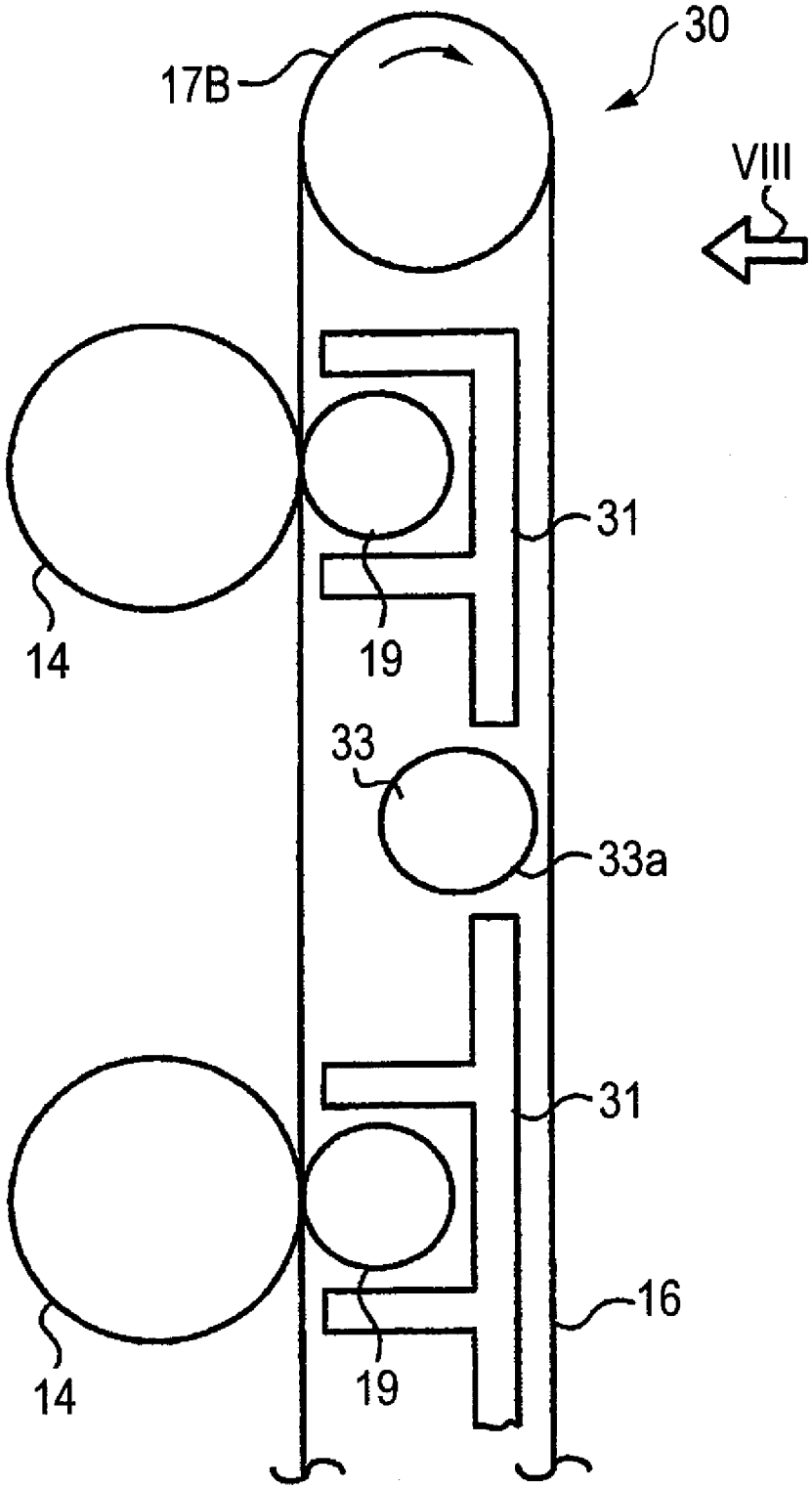
FIG. 7 is a diagram for explaining a transfer unit according to a second exemplary embodiment of the present invention.

FIG. 7 is a diagram for explaining a transfer unit 30 according to a second exemplary embodiment of the present invention. The basic arrangement for the transfer unit 30 in FIG. 7 is the same as that for the transfer unit of the first exemplary embodiment, and only the portion that is different will now be described. Further, the same reference numerals as are used for the first exemplary embodiment are also employed to denote identical or corresponding components, and for these components, no further explanation will be given.

As shown in FIG. 7, the transfer unit 30 includes a regulating roller (a rotary member) 33 that is rotatably supported by a box member 31. The regulating roller 33 is employed instead of the regulating member 32 in the first exemplary embodiment in order to prevent a conveying belt 16 from contacting the box member 31. The regulating roller 33 is so arranged that an outer surface 33*a* (a regulating portion) can contact the inner surface of the conveying belt 16. More specifically, the regulating roller 33 does not always contact the conveying belt 16, but instead, contacts it only when the conveying belt 16 fluctuates, and is thus able to regulate the movement of the conveying belt 16. If the regulating roller 33 were constantly in contact with the conveying belt 16, the tension provided for the conveying belt 16 would be affected, and an adjustment for belt walk would be required. Therefore, in this exemplary embodiment, the conveying belt 16 is employed to control the wobbling of the regulating roller 33.

Furthermore, when a three-axis arrangement is employed, by providing a support roller in addition to a driven roller 17A and a drive roller 17B, that arrangement is effective because a larger space, defined by the conveying belt 16, can be obtained. However, in this case, belt walk could occur, depending on the accuracy with which the support roller is positioned, and thus, precise management of the position of the support roller is required. In the event, rollers that prevent the fluctuation of the conveying belt 16 must merely be arranged so that they do not always contact each other, so that a space that is less affected by belt walk can be obtained inside the conveying belt 16.

Figure 8:
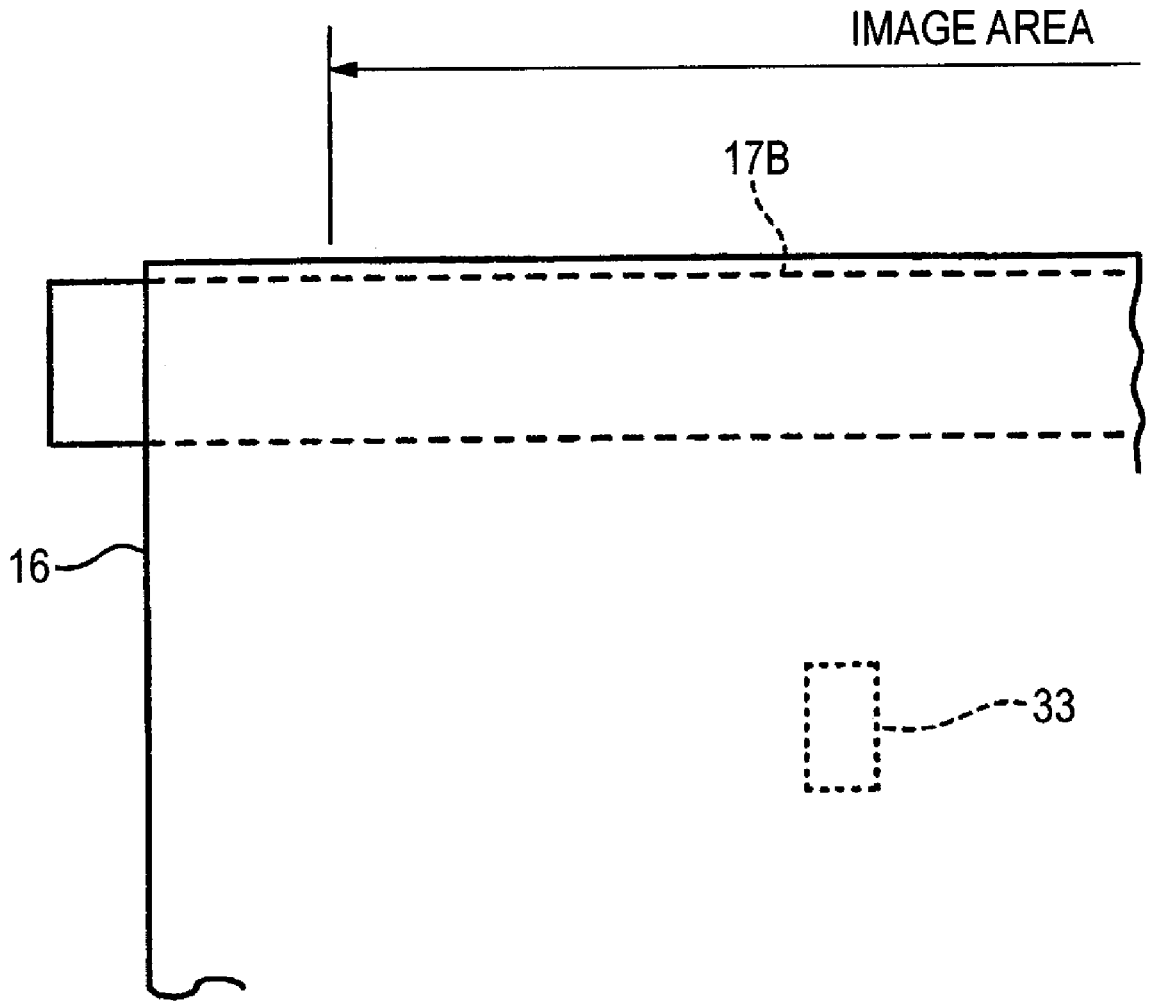
FIG. 8 is a diagram showing the transfer unit viewed from the direction indicated by an arrow VIII in FIG. 7.

FIG. 8 is a diagram showing the transfer unit 30 when viewed in the direction indicated by an arrow VIII in FIG. 7.

As shown in FIG. 8, the regulating roller 33 is attached to the box member 31 so that it is positioned inside the image area on the conveying belt 16. Since the regulating roller 33 is rotated by contact with the inner surface of the conveying belt 16, the degree to which the regulating roller 33 can damage the conveying belt 16 is less than the damage that can be inflicted by the regulating member 32 of the first exemplary embodiment. Therefore, when the regulating roller 33 is attached to the portion of the box member 31 corresponding to the image area, adverse image effects can be avoided, or reduced.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. An image forming apparatus for forming an image on a recording medium, which comprises:

a belt member that is capable of cyclic rotation;

a plurality of support members, along which the belt member is stretched;

a first member that is located immediately adjacent to an inner face of the belt member;

at least one transfer roller, wherein the first member holds the at least one transfer roller, and the first member is provided directly between the inner face of the belt member and the at least one transfer roller; and a regulator that is located opposite the inner face of the belt member, the regulator being at an opposite side of the first member with respect to the at least one transfer roller;

wherein the regulator maintains a cyclic rotating state for the belt member while ensuring the first member is separated by a gap from the belt member;

wherein the plurality of support members comprise a first roller and a second roller, and the belt member runs from the first roller to the second roller at an opposite side of the first member with respect to the at least one transfer roller;

further comprising a cleaning unit for cleaning the belt member, the cleaning unit being provided at the opposite side of the first member with respect to the at least one transfer roller and being positioned downstream of the first roller with respect to a belt member rotation direction, wherein the cleaning unit cleans the belt member by pressing the belt member toward the first member;

wherein the regulator is provided only at the opposite side of the first member with respect to the at least one transfer roller and is positioned downstream of the cleaning unit.

2. The image forming apparatus according to claim 1, wherein the regulator is provided on the first member.

3. The image forming apparatus according to claim 1, which further comprises:

a rotary member having a circumferential face which is rotatably located, wherein the regulator is arranged on the circumferential face of the rotary member.

4. The image forming apparatus according to claim 1, wherein the first member comprises a box member.

5. The image forming apparatus according to claim 4, wherein the box member is made of metal.

6. The image forming apparatus according to claim 4, wherein the at least one transfer roller comprises a plurality of transfer rollers provided at a front side of the box member.

7. The image forming apparatus according to claim 6, wherein a rear side of the box member is located along the inner face of the belt member; and the regulator ensures that the rear of the box member is separated by a gap from the belt member.

8. A transfer unit attached to an image forming apparatus that transfers a toner image to a recording medium, which comprises:

a transfer belt that is capable of cyclic rotation;

a plurality of support rollers, across which the transfer belt is stretched;

a second member that is located immediately adjacent to an inner face of the transfer belt; and at least one transfer roller, wherein the second member holds the at least one transfer roller, and the second member is provided directly between the inner face of the belt member and the at least one transfer roller; and a regulator that is located opposite the inner face of the transfer belt, the regulator being at an opposite side of the second member with respect to the at least one transfer roller;

wherein the regulator maintains a cyclic rotating state for the transfer belt while ensuring the second member is not contacted with the transfer belt;

wherein the plurality of support rollers comprise a first roller and a second roller, and the transfer belt runs from the first roller to the second roller at an opposite side of the second member with respect to the at least one transfer roller;

further comprising a cleaning unit for cleaning the transfer belt, the cleaning unit being provided at the opposite side of the second member with respect to the at least one transfer roller and being positioned downstream of the first roller with respect to a transfer belt rotation direction, wherein the cleaning unit cleans the transfer belt by pressing the transfer belt toward the second member;

wherein the regulator is provided only at the opposite side of the second member with respect to the at least one transfer roller and is positioned downstream of the cleaning unit.

9. The transfer unit according to claim 8, wherein the regulator is located in an area corresponding to an outside of an image area on the transfer belt.

10. The transfer unit according to claim 8, wherein the second member is made of metal, and the regulator is provided on the second member.

11. The transfer unit according to claim 8, wherein the plurality of support rollers include a drive roller that drives the transfer belt, and wherein the regulator is positioned downstream of the drive roller.

12. The transfer unit according to claim 8, wherein the second member comprises a box member.

13. The transfer unit according to claim 12, wherein the box member is made of metal.

14. The transfer unit according to claim 12, wherein the at least one transfer roller comprises a plurality of transfer rollers provided at a front side of the box member.

15. The transfer unit according to claim 14, wherein a rear side of the box member is located along the inner face of the belt member; and the regulator ensures that the rear of the box member does not contact the transfer belt.

* * * * *